US008109739B2

(12) United States Patent
Wrench et al.

(10) Patent No.: US 8,109,739 B2
(45) Date of Patent: Feb. 7, 2012

(54) DOSING PUMP FOR A LIQUID FUEL ADDITIVE

(75) Inventors: Nathan Wrench, Cambridge (GB); Helen Victoria Lewis, Cambridge (GB); Simon James Naylor, Cambridge (GB); Charles Douglas Johnstone, Nottinghamshire (GB); James Beeching Neave, London (GB)

(73) Assignee: Inergy Automotive Systems Research (Société Anonyme), Brussels (BE)

( * ) Notice: Subject to any disclaimer, the term of this patent is extended or adjusted under 35 U.S.C. 154(b) by 1113 days.

(21) Appl. No.: 10/570,590

(22) PCT Filed: Sep. 3, 2004

(86) PCT No.: PCT/EP2004/052022

§ 371 (c)(1), (2), (4) Date: Oct. 26, 2006

(87) PCT Pub. No.: WO2005/024219

PCT Pub. Date: Mar. 17, 2005

(65) Prior Publication Data

US 2007/0128054 A1 Jun. 7, 2007

(30) Foreign Application Priority Data

Sep. 5, 2003 (GB) ..... 0320880.8

(51) Int. Cl.
*F04B 17/00* (2006.01)

(52) U.S. Cl. ..... 417/413.1; 417/415; 417/417

(58) Field of Classification Search ..... 417/413.1, 417/415, 417

See application file for complete search history.

(56) References Cited

U.S. PATENT DOCUMENTS 3,250,225 A * 5/1966 Taplin ..... 417/413.1
3,756,456 A 9/1973 Georgi
4,336,000 A * 6/1982 Jorgensen et al. ..... 417/53

(Continued)

FOREIGN PATENT DOCUMENTS

DE 67 037 5/1969

(Continued)

OTHER PUBLICATIONS

Korean Preliminary Rejection mailed May 18, 2011 in Korean Patent Application 10-2006-7004432 (with English Translation).

*Primary Examiner* — Devon C Kramer
*Assistant Examiner* — Peter J Bertheaud
(74) *Attorney, Agent, or Firm* — Oblon, Spivak, McClelland, Maier & Neustadt, L.L.P.

(57) ABSTRACT

A dosing pump for a liquid additive in fuel of a heavy fuel engine includes a piston, a cylinder, and a high resolution linear actuator, including a motor driven by a controller, for moving the piston axially in the cylinder. The pump includes a manifold, and a low friction dish-shaped seal having a peripheral portion forming a seal between the cylinder and the manifold in a fully extended position of the piston. The dish-shaped seal includes a top portion attached to the piston that moves with the piston such that the top portion of the seal is compressed against the manifold in the fully extended position. The shape of the seal minimizes non-linearity of the volume dosed as a function of movement of the piston, and the controller drives the motor so as to remove a remaining non-linearity of the volume dosed as a function of movement of the piston.

11 Claims, 4 Drawing Sheets

U.S. PATENT DOCUMENTS

| | | | | |
|---|---|---|---|---|
| 4,449,650 | A | 5/1984 | Sawatzki | |
| 4,874,299 | A | 10/1989 | Lopez et al. | |
| 5,421,295 | A * | 6/1995 | Lemaire et al. | 123/179.7 |
| 6,568,926 | B1 * | 5/2003 | Mount | 417/568 |
| 2003/0136355 | A1 | 7/2003 | Gouzou et al. | |
| 2007/0209631 | A1 | 9/2007 | Campenon et al. | |

FOREIGN PATENT DOCUMENTS

| | | |
|---|---|---|
| DE | 36 00 341 | 7/1987 |
| DE | 196 23 537 A1 | 12/1997 |
| DE | 199 06 482 | 9/2000 |
| DE | 199 10 920 A1 | 9/2000 |
| DE | 202 04 411 U1 | 7/2002 |
| EP | 0 614 002 | 9/1994 |
| EP | 1 132 616 | 9/2001 |
| FR | 2 862 027 | 5/2005 |
| FR | 2 865 688 | 8/2005 |
| GB | 2 181 493 | 4/1987 |
| GB | 2 282 419 A | 4/1995 |
| JP | 60-108516 | 6/1985 |
| JP | 7 224734 | 8/1995 |
| KR | 20-0123549 | 8/1998 |

* cited by examiner

DOSING PUMP FOR A LIQUID FUEL ADDITIVE

TECHNICAL FIELD

The invention concerns a dosing pump for a liquid additive (possibly very concentrated) either in the engine of a vehicle; in the exhaust gases of said engine; or in the case of an engine using a heavy fuel (i.e. fuel having more than 9 carbon atoms; typically diesel), directly in said fuel and preferably, in the fuel tank.

The aim of additives like urea, liquid ammonia, and carbamates is to lower the emission of pollutants like NOx and CO by the engine, while metallic salts (like salts of iron (Fe) or cerium (Ce) in solution in a hydrocarbon solvent) are generally used in order to lower the combustion temperature of the particles retained on the filter of the exhaust system of heavy fuel engines.

BACKGROUND ART

Existing systems use a conventional piston pump to dose additive liquid where it has to be injected (mostly in the engine, the exhaust gases, the fuel tank, the fuel feed pipe or the fuel return pipe of said engine; this will generally be called "engine circuit" in the present application). This piston pump is a fixed volume pump, where the pump doses a constant pre-set volume per stroke (generally depending on the volume of the cylinder in which the piston moves).

US Patent Application 2003/0136355 discloses a system for feeding a fuel additive inside a fuel tank by means of a metering pump which is integrated in the fuel-drawing module. This metering pump is a positive displacement pump (piston pump) delivering a constant volume of additive on each pump cycle. The total required dose is delivered by actuating the pump the required number of cycles. The disadvantages are:

- that any error associated with the piston volume is accumulated over the number of strokes, while an accurate dose is required for optimal results;
- possible overdosing (because of the incapacity of delivering fractions of the cylinder volume), which is expensive considering the price of the additive; and
- that the solenoid valves used for the actuation are typically noisy.

The new invention aims at resolving at least some of these disadvantages.

DESCRIPTION OF THE INVENTION

The invention consists mainly in replacing the fixed volume pump described above with a variable volume pump, i.e. a pump capable of delivering a volume which is not necessarily pre-set.

Accordingly, the present invention concerns a dosing pump for a liquid additive of the engine circuit of a vehicle, the pump comprising a piston, a cylinder and an actuator for moving the piston axially in the cylinder, and the actuator being a high resolution linear actuator.

Thanks to the use of such an actuator, the pump according to the invention is a variable volume pump, capable of delivering any required volume and being self-priming.

The pump according to the invention generally comprises besides the piston, the cylinder (housing) and the actuator, a manifold comprising at least one inlet and one outlet check valve for respectively inhaling and exhaling the additive. Such valves may be of any type; they are preferably passive (i.e. valves functioning automatically, i.e. not being actuated by any other means than the flow of liquid through them), one-way valves (i.e. they only allow one flow direction of liquid through them).

The variable volume pump of the invention is preferably a syringe pump, i.e. a pump in which the piston contacts a solid surface (which may be the end of the pump cylinder bore or the inner surface of the manifold) at the end of each dose cycle. By "dose cycle," it is meant the complete sequence of operations between 2 successive inhalations of the pump. At the end of each cycle, the syringe returns to an end stop, ensuring high repeatability. Besides, the volume of additive left in the pump body after each cycle is minimized, which in turn minimizes the potential risk of leaks of gas or vapor from the additive that may occur during temperature changes.

By "high resolution linear actuator" according to the invention, it is meant in fact an actuator of which the linear position can be controlled to a high resolution. By "high resolution," it is meant that the accuracy must be of less than or equal to 1 mm, preferably less than or equal to 0.1 mm, more preferably less than or equal to 50 μm. The linear actuator used in the invention preferably comprises an electrical stepper motor which moves the piston at very small increments, to achieve very high accuracy per single step, and which is controlled by a controller. The advantages of such an actuator are its small size (compactness) and its low power consumption, when compared to a solenoid pump for instance.

Most preferably, the linear actuator is driven by a rotary electric motor through a gear reduction. The benefits being that:

- the gear reduction affords high precision in linear position that corresponds to a high accuracy in volumetric dosing of the additive, and is not noisy; and
- the gear reduction affords high resistance to piston travel when the rotary electric motor is not energized, thus ensuring that the piston maintains a seal against the inlet and outlet apertures.

Other possibilities for controlling the actuator's linear position to a high resolution are:

(A) a crank driven through a gear reduction so that the linear position of the crank end (piston) may be controlled to a high degree of accuracy (and reversed at any point in the cycle); and (B) a linear actuator driven by a linear electric motor such as a piezoelectric motor.

In the case of the crank (embodiment A), a long crank can be used to give largely linear motion to the piston.

According to one embodiment, the pump according to the invention has a capacity equal to the maximum dose required (considering the volume of fuel involved), and dispenses a volume up to the maximum dose. This means that the required additive volume is delivered through only one cycle of the pump, which is indeed a very silent solution, but is of somewhat larger size.

According to another, preferred embodiment, the pump according to the invention has a shrunken capacity (i.e. lower than the maximum dose) in order to fit into more locations on the vehicle. The pump dispenses the required additive volume by one or more injections (i.e. through one or more pump cycles).

In that embodiment, the piston exactly fits the manifold so that all the additive is repeatably squeezed out. This means the pump only needs to be accurate when inhaling.

The pump according to the invention generally uses a seal to ensure tightness between the piston and the cylinder. This seal may be a sliding seal, disposed radially on the piston head and sliding with the piston inside the cylinder. But preferably, this seal is a low friction dish seal (diaphragm) having at least one portion attached to the cylinder and moving with it. The benefits of such a seal are that:

- much lower forces are presented to the motor when the piston is first moved after an important period of non-use, avoiding slipping of the motor and guaranteeing the pump accuracy;
- a layer of additive is not left on the internal surface on the syringe to dry and flake off, avoiding potential electrical short circuits or jamming of a mechanism; and
- leakage is impossible and in consequence the accuracy is conserved.

Another advantage of the diaphragm seal is that it can accommodate radial movement, making it quite compatible with a fixed crank linear actuator (embodiment A described above).

In that regard, it is worth noting that although the main object of the present invention is a pump driven by a high resolution linear actuator, all the advantages of the diaphragm seal described above are also present in the case of a pump without such an actuator. While such a pump is known from U.S. Pat. No. 4,874,299, the pump described therein is a reciprocating one, i.e. a fixed volume pump and not a variable volume pump. Accordingly, a variable volume pump with a diaphragm which would be as described above except for the presence of a linear actuator, is another aspect of the present invention. Although, for dosing diesel additives, the choice of a linear actuator is preferred.

The materials of which the pump according to the invention are made of are chosen to be resistant to the additive to be dosed. Generally, the piston and cylinder are plastic (like PBT (polybutylene) for instance) and the seal(s) are elastomeric, most preferably a fluorinated silicone elastomer. In the case of a dish seal, its shape and material are very important to prevent stretching of the seal when the pump 'inhales'. The profile of the seal is preferably designed so that the forces (and hence, the stretching of the seal) are minimized during inhalation. Other means may include material reinforcement of the seal or coating the seal with a material like PTFE (polytetrafluoroethylene, commonly called "Teflon") to prevent stretch (and increase material compatibility).

In dosing pumps using a dish seal, the volume dosed is not linear with movement of the piston. However, the shape of the seal is adapted to minimize that phenomenon and the remaining non-linearity is removed electrically (by the controller that drives the motor).

Preferably, the dosing pump according to the invention is part of the fuel system of a heavy fuel engine. Therefore, according to another aspect, the present invention concerns a fuel system equipped with a dosing pump as described above. By fuel system, it is meant all the elements/devices which are used in the fuel handling (storage, supply and return in the case of diesel). Such a system generally comprises at least a fuel tank, a filler pipe, venting lines, and fuel supply/return lines, as well as an additive reservoir in the frame of the present invention.

According to that embodiment, the pump is preferably located in one of the following locations within the fuel system:

a. in the filler pipe area, especially if the additive reservoir is located there as described in patent application FR 03.13073;
b. between the additive reservoir and the fuel tank;
c. on the fuel tank, above or under it (especially if the additive reservoir is integrated to the fuel tank as described in patent application FR 04.00856); in that case, it preferably is close to the fuel drawing module fixed on the tank;
d. within the fuel drawing module as described in the above mentioned US patent; or
e. close to or on the fuel return line (returning hot fuel from the injection rail of the engine to the fuel tank).

This is namely so that a common pump body design can be incorporated into many different system configurations, through the use of bespoke fluid manifolds as described above.

The controller of the dosing pump according to that embodiment may be told the amount of additive to dose, or preferably, the amount of fuel that has been added (so that the processor can calculate the required dose—only the controller needs to know the concentration and type of additive in use).

BRIEF DESCRIPTION OF THE DRAWINGS

The present invention is illustrated in a non-limiting way by FIGS. 1 to 4, which in fact depict 2 preferred embodiments of the present invention.

In these figures, identical numbers refer to identical/similar items.

DESCRIPTION OF FIGS. 1 AND 2

Embodiment 1

Figure 1:
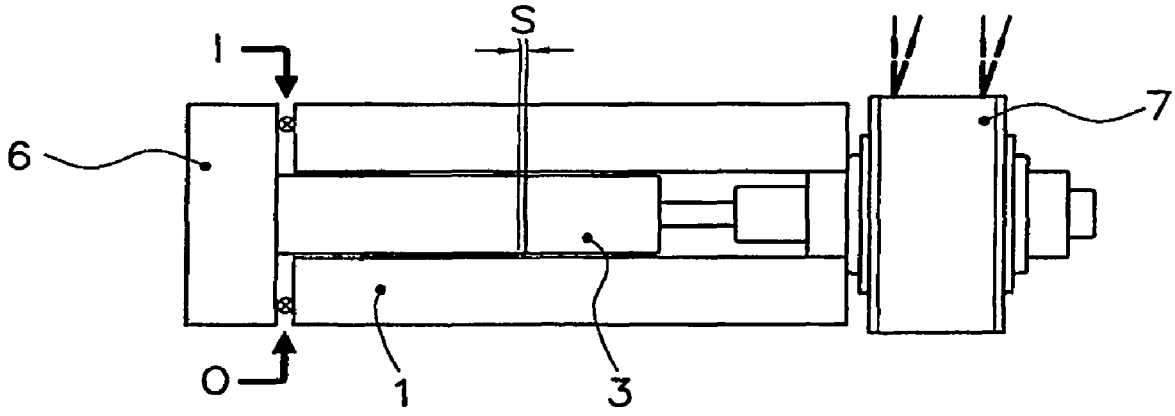
FIG. 1 illustrates a sectional view of a syringe pump with a sliding seal according to a first embodiment.

These figures represent a syringe pump with sliding seal having a capacity of about 8 ml.

The syringe inhales through an in-hole (I) in manifold (6), seal (5) and one-way valve (2), the additive liquid, by the piston (3) performing only a single proportional course at a calculated dosing quantity.

The piston (3) moves by means of a stepper motor and gear reduction which are part of an actuator (7). There is a sliding seal (4) between the piston (3) and the cylinder (1).

After the liquid inhalation, the syringe pushes through an out-hole (0) in support (6), seal (5') and one-way valve (2'), the additive liquid, by the piston (3), to the diesel fuel tank.

DESCRIPTION OF FIGS. 3 AND 4

Embodiment 2

These figures represent a membrane-syringe pump with dish seal having a capacity of about 0.5 ml.

Figure 3:
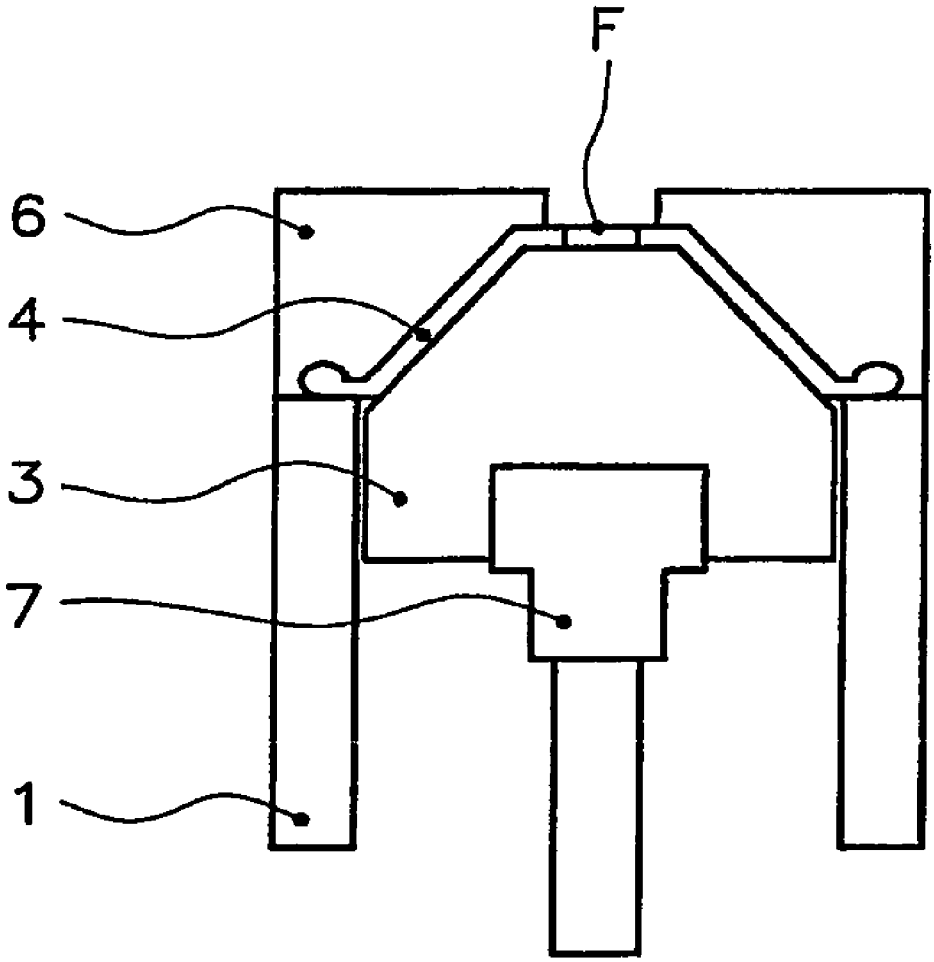
FIG. 3 illustrates a sectional view of a syringe-membrane pump according to a second embodiment.

Its storage/reset position is shown in FIG. 3. The piston pushes the seal (4) up against the manifold (6), i.e. its end-stop.

The seal (4) is fixed between the cylinder (1) and manifold (6) at its perimeter (forming an additive tight seal) and attached to the piston (3) via its flat top (F). When the piston (3) moves, the top of the seal (F) moves with it and a void is created between the manifold (6) and the seal (4).

The syringe inhales through an in-hole in manifold (6) and one-way valve (2), the additive liquid, by the piston (3) performing a multiple of strokes up to the calculated dosing quantity.

The piston (3) moves by means of a stepper motor and gear reduction which are part of an actuator (7), which in this case is made in one piece with the cylinder (1).

The following sequence defines one cycle of the pump:

The stepper motor is driven by the controller so that it rotates through a set number of steps. The number of steps is equivalent to a predetermined linear travel.

As the piston (3) moves, the cracking pressure of the inlet valve is exceeded and additive flows into the void created between the manifold (6) and seal (4).

The piston (3) stops when the motor has turned the number of steps instructed by the controller. It then changes direction and the outlet check valve (not shown) and diesel tank check valves open once their combined cracking pressures have been exceeded. Additive flows from the void and into the diesel tank until the piston (3) bottoms out against the manifold (6).

The volume of additive dosed is dependent on the volume of the void formed between the manifold (6) and the seal (4). This volume is determined by the convolution formed by the seal (4) when the piston (3) is displaced. A dose comprises of one or more cycles, and between each cycle, the motor drives the linear actuator to its storage/reset position.

Pump resolution, size and accuracy of a single step, is a function of the stepper motor resolution and is constant and independent of the volume delivered.

The syringe-membrane pump delivers the entire pump volume within a short period of time.

Figure 2:
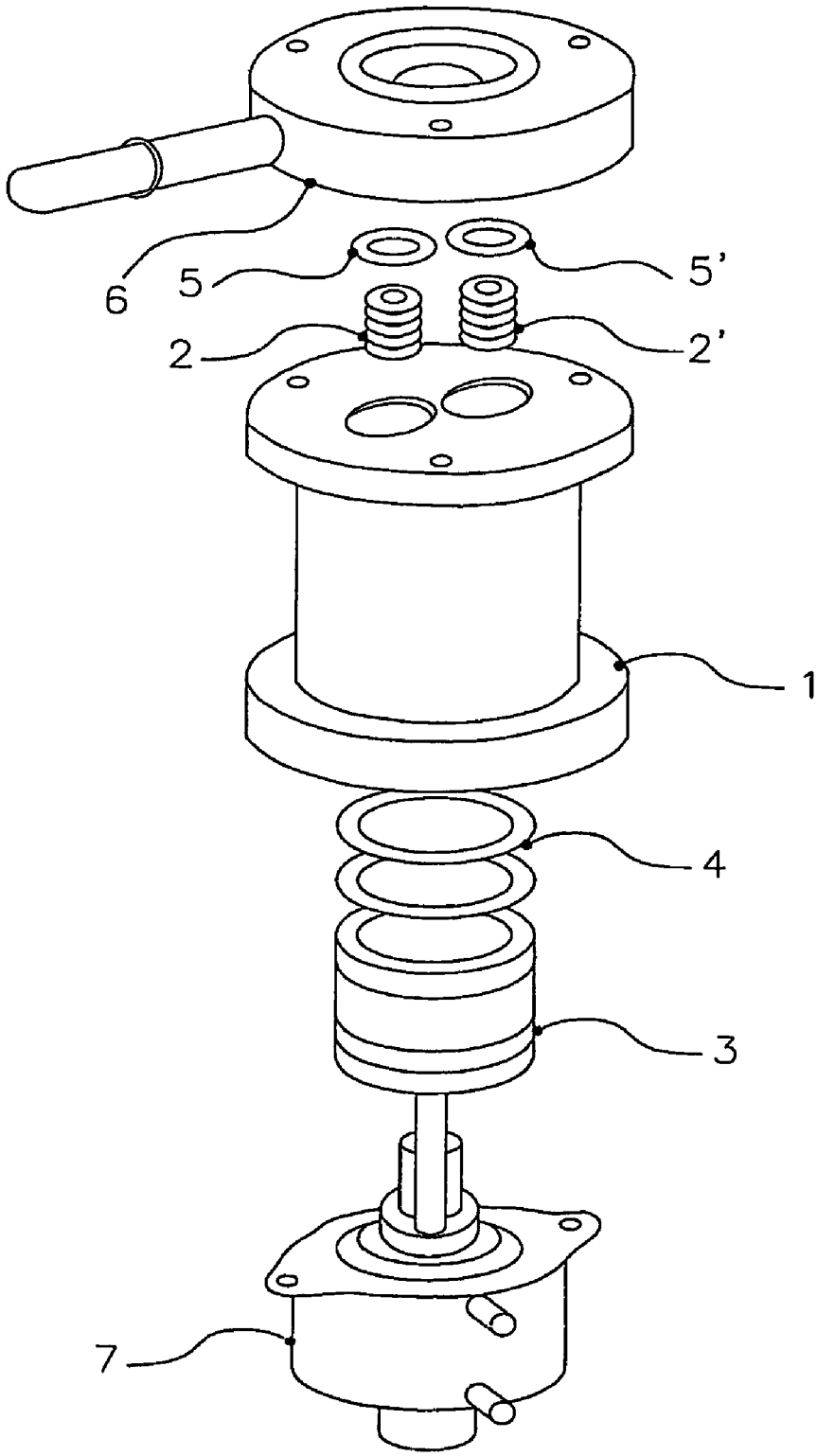
FIG. 2 illustrates an exploded view of a syringe pump with a sliding seal according to the first embodiment.
Figure 4:
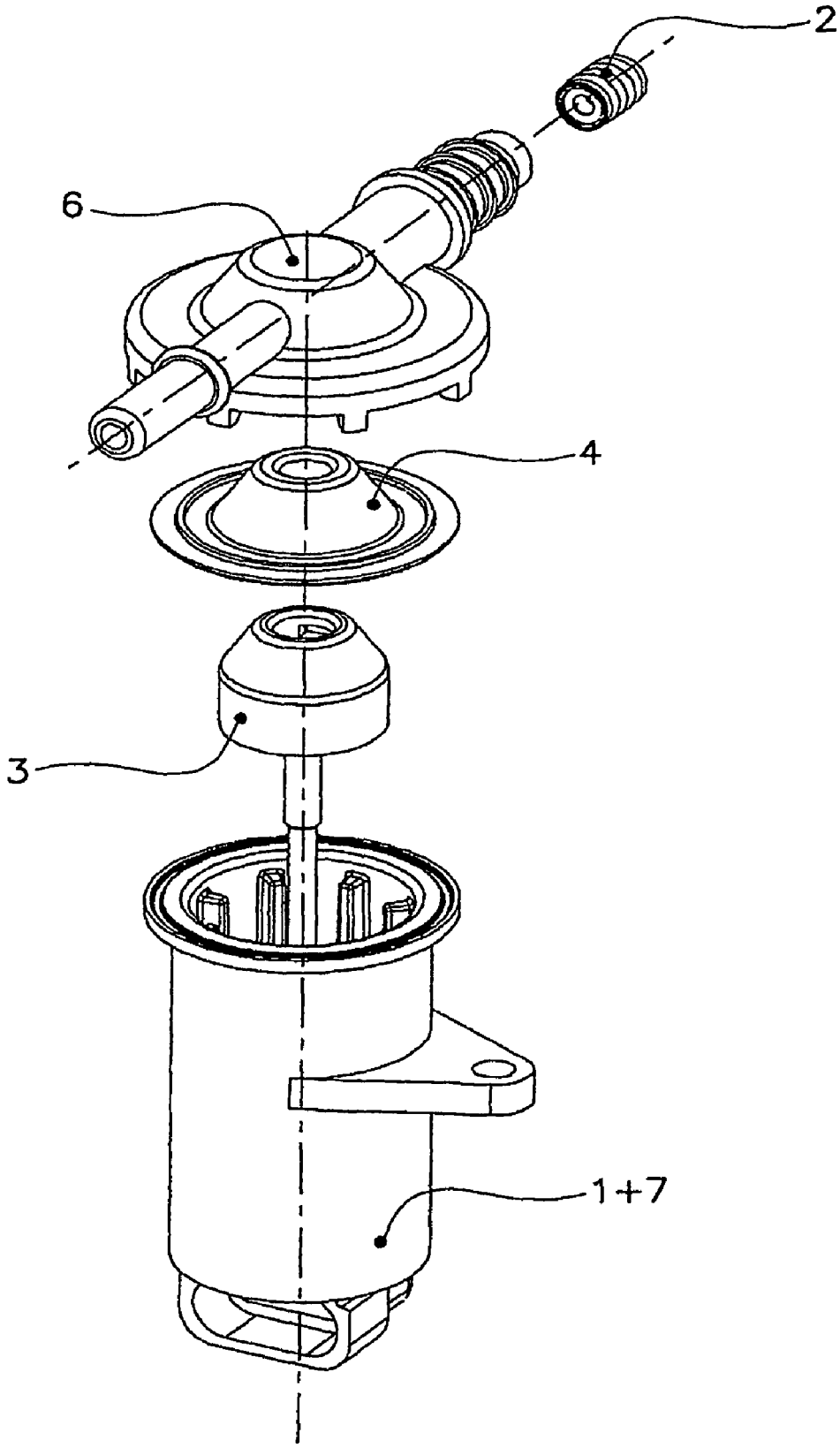
FIG. 4 illustrates an exploded view of a syringe-membrane pump according to the second embodiment.

Common Features of Embodiment 1 (FIGS. 1 and 2) and 2 (FIGS. 3 and 4)

Both pumps allow performing a dosing of very concentrated additive liquid (metal concentration rate 10% for instance) for an addition of diesel fuel (between 5 and 120 liters).

The minimum linear step of the piston (3) is very small, in the range of 10 to 50 μm.

The electric power consumption is very low (for instance 5 Watts at 12 Volts).

Two simple passive valves are used and the system is flexible across a wide range of dose levels.

This concept is not noisy since it uses passive valves instead of solenoid valves.

The invention claimed is:

1. A dosing pump for a liquid additive in fuel of a heavy fuel engine, said pump comprising:

a piston;

a cylinder;

an actuator for moving the piston axially in the cylinder, wherein the actuator is a high resolution linear actuator comprising a motor driven by a controller, a manifold, and a low friction dish-shaped seal having a peripheral portion forming a seal between the cylinder and the manifold in a fully extended position of the piston, said dish-shaped seal further having a top portion attached to the piston and moving with the piston such that said top portion of the seal is compressed against the manifold in said fully extended position of the piston, wherein the shape of the seal is configured to minimize non-linearity of the volume dosed as a function of movement of the piston, and wherein the controller is configured to drive the motor so as to remove a remaining non-linearity of the volume dosed as a function of movement of the piston.

2. The dosing pump according to claim 1, wherein said manifold has at least one inlet and one outlet check valve that are passive, one-way valves.

3. The dosing pump according to claim 1, wherein said pump is a syringe pump of which the piston contacts a solid surface at an end of each dose cycle.

4. The dosing pump according to claim 1, wherein the linear actuator is driven by a rotary electric motor through a gear reduction.

5. The dosing pump according to claim 1, wherein said heavy fuel engine defines a maximum dose of additive for optimal conditions and said pump has a capacity equal to said maximum dose so that a required additive volume is always dispensed through only one cycle of the pump.

6. The dosing pump according to claim 1, wherein said heavy fuel engine defines a maximum dose of additive for optimal conditions and said pump has a capacity lower than said maximum dose so that a required additive volume is dispensed through one or more pump cycles.

7. A fuel system comprising a liquid fuel additive dosing pump according to claim 1.

8. The dosing pump according to claim 1, wherein the actuator has an accuracy of less than or equal to 0.1 mm.

9. The dosing pump according to claim 8, wherein the actuator has an accuracy of less than or equal to 50 μm.

10. The dosing pump according to claim 1, wherein said dish-shaped seal and said manifold are configured so as to create a void between said top portion of the seal and said manifold when said seal moves with said piston away from said fully extended position, and wherein said liquid additive flows into the void created between the manifold and the seal via an inlet valve.

11. The dosing pump according to claim 10, wherein said liquid additive flows out from said void created between the manifold and the seal via an outlet valve when said seal moves with said piston toward said fully extended position.

* * * * *